US005972555A

United States Patent [19]

Fernandez-Puente

[11] Patent Number: 5,972,555

[45] Date of Patent: Oct. 26, 1999

[54] USE OF MICROVESICLES CONTAINING A SILVER HALIDE DEVELOPING AGENT TO FORM A PHOTOGRAPHIC IMAGE

[75] Inventor: Laurent G. Fernandez-Puente, Chalon sur Saone, France

[73] Assignee: Eastman Kodak Company, Rochester, N.Y.

[21] Appl. No.: 09/203,057

[22] Filed: Dec. 1, 1998

[30] Foreign Application Priority Data

Dec. 1, 1997 [FR] France ..... 9715348

[51] Int. Cl.[6] ..... G03C 1/42

[52] U.S. Cl. ..... 430/138; 430/405; 430/448

[58] Field of Search ..... 430/138, 405, 430/448

[56] References Cited

FOREIGN PATENT DOCUMENTS

| | | |
|---|---|---|
| 0 802 452 A1 | 10/1997 | European Pat. Off. . |
| 2677897 | 6/1991 | France . |
| 2689418 A1 | 4/1992 | France . |
| 2 113 416 | 1/1983 | United Kingdom . |
| 90/13361 | 11/1990 | WIPO . |

*Primary Examiner*—Hoa Van Le
*Attorney, Agent, or Firm*—J. Lanny Tucker

[57] ABSTRACT

The invention relates to a silver halide photographic image forming process in which a developing agent incorporated into microvesicles is used. The developing agent is encapsulated in multilamellar microvesicles, and these microvesicles are then brought into contact with the exposed silver halides in the presence of an alkaline activator upon development. Application to the design of a simplified processing of silver halide photographic materials.

8 Claims, 1 Drawing Sheet

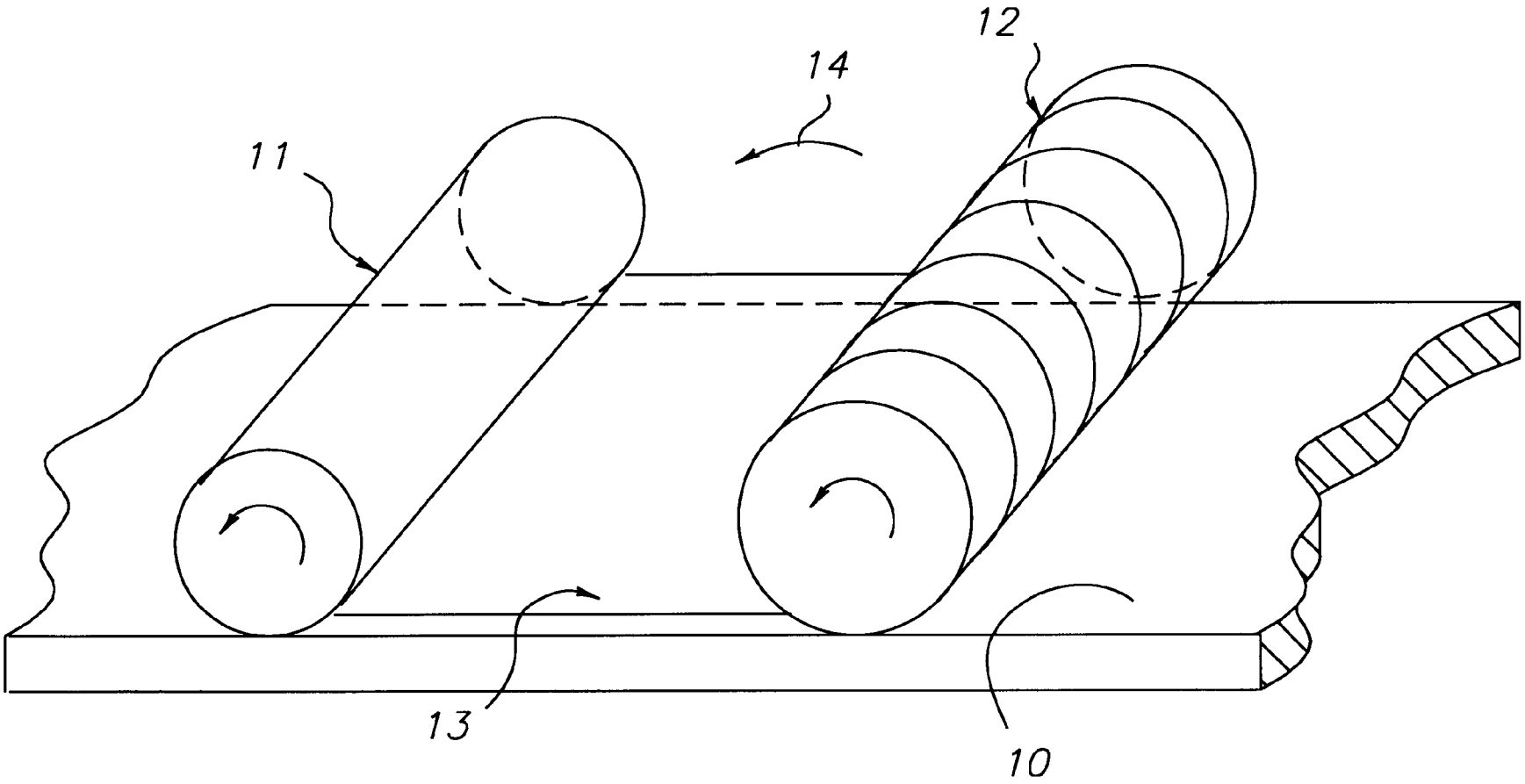
12
14
11
10
13

USE OF MICROVESICLES CONTAINING A SILVER HALIDE DEVELOPING AGENT TO FORM A PHOTOGRAPHIC IMAGE

FIELD OF THE INVENTION

This invention relates to a process for obtaining an image in a material containing light-sensitive silver halides by developing this material using microvesicles containing a silver halide developing agent in the presence of an activator. The invention also relates to a photographic material for the practice of this process.

BACKGROUND OF THE INVENTION

A conventional process in photography is to imagewise expose a silver halide emulsion layer, then to develop the resulting latent image with an alkaline solution of a silver halide developing agent, such as hydroquinone, to obtain a silver image in the latent image areas. Usually, the image thereby obtained is then fixed.

It has been contemplated to incorporate the developing agent in the photographic material, for example, in the silver halide emulsion layer. In this case, the development of the exposed emulsion can be set off simply by applying an aqueous alkaline solution. If the alkali is also incorporated in the photographic material, the development can be triggered simply by a water washing.

Systems of this type, incorporating all the ingredients necessary for development, have been described for example in French Patents Nos. 1 257 893, 1 500 987, 1 591, 741, and in British Patent No. 999 247.

A current tendency is thus to simplify the processing of halide photographic materials, especially by incorporating the developing agent in the photographic material. However, the coexistence in the same material of the light-sensitive silver halides and the developing agent brings its own problems, especially concerning stability and keeping conditions.

The purpose of this invention is to solve this problem by providing a process that uses a silver halide developing agent incorporated in surfactant multilamellar microvesicles.

SUMMARY OF THE INVENTION

This invention provides a method of forming an image in a light-sensitive silver halide emulsion layer of a photographic material, comprising:

(a) exposing the photographic material, and (b) contacting the exposed material with a composition comprising a binder in which are dispersed microvesicles containing a silver halide developing agent, the contacting occurring in the presence of an alkaline activator, this method characterized in that the microvesicles are multilamellar microvesicles comprising at least one surfactant, a polar medium and the silver halide developing agent, prepared from a homogeneous lyotropic liquid-crystal lamellar phase comprising at least the surfactant, polar medium and silver halide developing agent, the lamellar phase then being sheared by stirring.

There is also provided a photographic material comprising a support, at least one light-sensitive silver halide emulsion layer and multilamellar microvesicles comprising at least a surfactant, a polar medium, and a silver halide developing agent, prepared from a homogeneous lyotropic liquid-crystal lamellar phase comprising the surfactant, the polar medium and the developing agent.

DETAILED DESCRIPTION OF THE INVENTION

The term "interactive" means the contact allows a reaction between the exposed light-sensitive emulsion and the compound incorporated in the microvesicles, in the presence of a photographic activator, namely an aqueous alkali. Preferably, the composition containing the microvesicles and the binder is located in a layer adjacent to the emulsion layer.

The method of preparation of the microvesicles is described in Patent Application WO 95/19707. In this method, a lamellar liquid crystal phase is prepared, and the active substance, here the silver halide developing agent, is dissolved therein. The multilamellar microvesicles form spontaneously. According to a procedure, for example, one or several surfactants are mixed with the developing agent and a polar liquid, the latter in the smallest possible amount to obtain a homogeneous composition. A lyotropic liquid crystal phase is obtained that can be identified by polarizing microscopy or X-ray diffraction. This phase has usually a high viscosity. In a second step the viscous composition is diluted in a polar liquid, such as water or a hydroxylated compound, to produce the microvesicles.

The microvesicles are multilamellar, i.e., they comprise concentric lamellae, lending them an onion-like structure.

The polar medium, in view of the substance to be incorporated in the microvesicles (a developing agent of the hydroquinone type), is a hydrophilic compound such as an alcohol or a polyol, such as glycerol, polyethylene glycol (PEG 400 or 1000), or water itself. Mixtures of polar liquids can be used, e.g., water-polyglycol mixtures. In an embodiment, the developing agent and the polar medium are mixed at a temperature of from 40 to 100° C., depending on the nature of the polar medium, with stirring. The concentration depends on the developing agent and the polar medium, but for example 10 to 60% by weight of developing agent is used relative to the mass of developing agent plus polar medium.

The surfactants are ionic, nonionic or amphoteric, such as fatty acid derivatives with saturated or unsaturated c6 to C20 carbon chains, especially esters of sorbitan and fatty acids, e.g., sorbitan mono-oleate, sorbitan mono-stearate, polysorbates, or ethoxy esters, in particular polyethoxy sorbitan esters, e.g., polyethoxysorbitan monostearate or mono-oleate, polyglycols such as polyalkene glycols. In ionic surfactants, the polar moiety can be anionic, e.g., ethoxylate, sulfate or sulfonate, or cationic, e.g., quaternary ammonium. Examples of amphoteric surfactants include lecithine and betaine.

In a preferred embodiment, a mixture of two surfactants chosen among those mentioned above is used. Examples of mixtures of surfactants include mixtures of polysorbate and sorbitan stearate.

In practice, 0.5 to 70%, preferably 5 to 50% by weight of surfactants is used relative to the lamellar phase.

A specific embodiment for preparing the microvesicles used in the invention was described in Patent Application WO 93/19735. This method comprises a first step in which a homogeneous lamellar phase is prepared consisting of at least one surfactant and at least one polar liquid. This lamellar phase is of the lyotropic liquid-crystal type. It also contains the substance to be incorporated in the microvesicles.

In a second step, the method described in Patent Application WO 93/19735 includes a constant shearing step, performed either in a device of the double concentric cylinder Couette cell type, or in a plane-cone cell type device. These devices, which are widely known, are generally used to measure visco-elastic properties (e.g., Carrimed or Rheometrix rheometers). In an embodiment, this operation is carried out in an inert atmosphere. The lamellar phase is subjected to constant shearing for several minutes to several hours, according to the shear speed used. This shearing produces a composition that comprises a high concentration of monodispersed microvesicles. The size of the microvesicles is inversely proportional to the square root of the shear speed.

The particle size is measured by polarized light microscopy, or by laser beam diffusion, or by electron microscopy.

This size ranges between 0.1 and 50 $\mu$m, preferably between 0.5 and 10 $\mu$m.

The particles obtained by this method are monodispersed (dispersion less than 20%, and preferably less than 10%). They exhibit a high stability, so they can be used without special precautions to prepare dispersions for photographic layers. At least about 90%, and even 95% by weight of developing agent incorporated in the lamellar phase is finally incorporated in the microvesicles.

To disperse the microvesicles to prepare a coatable composition, binders and dispersing agents usually employed in photographic layers can be used. These binders and dispersing agents are hydrophilic colloids, essentially proteins in aqueous dispersions, such as aqueous dispersions of gelatine or modified gelatine (e.g., phthalyl or acetyl gelatines). Such substances are found, for example, in Research Disclosure No. 36544, September 1994, page 507, Photographic Silver Halide Emulsions, Preparations, Addenda, Systems and Processing, Section II, A.

The dispersions may additionally contain additives to improve mechanical properties, preservatives, antioxidants, UV absorbers, hardeners, or viscosity regulators. The dispersions are applied by conventional photographic coating techniques. All these aspects are described with references in the above-mentioned Research Disclosure publication.

The layer containing the microvesicles can be coated as an integral layer of a photographic material comprising a support and at least one light-sensitive silver halide layer. The microvoid layer can be sandwiched between the support and the light-sensitive layer(s).

The microvoid layer can also be coated on a separate support and brought into contact with the silver halide layer of an exposed photographic material, in the presence of an activator, upon development.

In all cases, the microvoid layer releases the developing agent incorporated in the microvesicles in the presence of an activator, i.e., an aqueous solution comprising an alkali such as sodium or potassium hydroxide, or a basic carbonate, that will afford a pH greater than 10, preferably greater than 12. The activator can additionally contain conventional additives such as sulfite, antifoggant, development accelerators, or wetting agents.

The developing agent is a hydroquinone-type agent, i.e. hydroquinone, alkylhydroquinones (in which the alkyl radical has preferably 1 to 5 carbon atoms, e.g., methyl, ethyl, isopropyl, t-butyl), sulfohydroquinone, sulfonated alkylhydroquinones, of the phenidone or substituted phenidone type, ascorbic acid type, or a derivative of ascorbic acid or reductone. The microvesicles can contain one or more developing agents to form synergistic associations.

Preparation of Microvesicles Containing a Developing Agent 16 g of methylhydroquinone was dissolved in 34 g of glycerol for 30 minutes at 90° C. with stirring.

In an emulsifier, 10 g of Montanox 60 polysorbate (surfactant commercially available from SEPPIC), and 40 g of Montane 60 sorbitan stearate (surfactant commercially available from SEPPIC) were added. The mixture was heated to 70° C. The solution of methylhydroquinone in glycerol was then added to the melt surfactant mixture, and the whole was mixed for 30 minutes at 70° C. The resulting mixture was then allowed to cool to room temperature with stirring (shearing). A momogeneous paste was obtained. Microscopic examination under polarized light revealed the presence of microvesicles of diameters in the range 1 to 2 $\mu$m.

Preparation of the Microvoid Dispersion

The paste obtained in the previous step was placed in a reactor. Deionized water containing $Na_2S_2O_5$ was added, followed by a preservative (Preserval PE®, a mixture of phenoxyethanol and alkyl parabenes). The mixture was stirred for 2 h to obtain a complete dispersion.

The dispersion contained, by weight:

50% microvesicles
0.05% $Na_2S_2O_5$
0.8% Preserval PE®
49.15% water

This dispersion was used in the example below to prepare a layer for the production of a development system for a photographic silver halide material.

EXAMPLE 1

The following layers were successively coated onto an ESTAR® poly(ethylene terephthalate) support:

(1) a gelatine layer (1.8 g/m$^2$) containing 3.5% by weight, based on gelatine, of bis-vinylsulfonylmethyl ether (hardener), 0.4 g/m$^2$ of latex (acrylic terpolymer), 1.5 g/m$^2$ of t-butylhydroquinone and 0.1 g/m$^2$ of 4-hydroxymethyl 4-methyl-1-phenyl pyrazolidone (HMMP);

(2) a silver chlorobromide (70/30% by moles) emulsion layer containing 2.8 g/m$^2$ of silver and 1.75 g/m$^2$ of gelatine, chemically sensitized with sulfur and gold, and spectrally red-sensitized.

(3) an overcoat layer of gelatine (8 g/m$^2$)

This photographic material was exposed through an 18-step sensitometric wedge (0.1 increments) with a xenon flash exposure meter for 2 $\mu$sec through a Wratten W29 filter.

The exposed material 10 was processed using an applicator of the type schematically illustrated in FIG. 1, comprising a set of two motor-driven rollers 11–12 (motor non shown). The surface of roller 12 was grooved to improve spreading of the liquid. 2 mL of an activator solution 13, the composition of which is given below, was placed in the space between the two rollers.

| Activator: | |
|---|---|
| 5-nitroindazole | 0.2 g/L |
| 2-methylaminoethanol | 70.0 g/L |
| KBr | 5.0 g/L |
| $K_2SO_3$ | 99.0 g/L |
| 1-phenethyl-2-methylpyridinium bromide | 2.0 g/L |
| Wetting agent, LODYNE/S 100 ®* | 30 mg/L |
| pH 12 | |

*25% aqueous solution

The two rollers were moved in the direction 14 on the surface of the film to be processed. A layer of activator solution was thereby formed that allows development of the film. The two rollers were then moved in the opposite direction to eliminate the excess activator solution. In this embodiment, the activator solution remained in contact with the film for 20 seconds. The film was then placed successively in a stop bath (30 seconds), a fixing bath (RP X-OMAT fixer, 1 minute at 25° C.), and a washing bath (2 minutes). A developed silver image was obtained (Dmin: 0.1–Dmax 1.2).

The invention has been described in detail with particular reference to certain preferred embodiments thereof, but it will be understood that variations and modifications can be effected within the spirit and scope of the invention.

I claim:

1. A method of forming an image in a light-sensitive silver halide emulsion layer of a photographic material, comprising:

(a) exposing said photographic material, and (b) contacting said exposed material with a composition comprising a binder in which are dispersed microvesicles containing a silver halide developing agent, said contacting occurring in the presence of an alkaline activator, this method characterized in that the microvesicles are multilamellar microvesicles comprising at least one surfactant, a polar medium and said silver halide developing agent, prepared from a homogeneous lyotropic liquid-crystal lamellar phase comprising at least said surfactant, polar medium and silver halide developing agent, said lamellar phase then being sheared by stirring.

2. The method of claim 1 wherein said developing agent is hydroquinone or a substituted hydroquinone.

3. The method of claim 2 wherein said developing agent is an alkylhydroquinone, the alkyl group containing 1 to 5 carbon atoms.

4. The method of claim 3 wherein said developing agent is methylhydroquinone or t-butyl-hydroquinone.

5. The method of claim 1 wherein said surfactant is nonionic.

6. The method of claim 1 wherein said microvesicles comprise a second surfactant.

7. The method of claim 1 wherein said microvesicles have sizes in the range of from 0.1 to 50 $\mu$m.

8. The method of claim 1 wherein said composition comprising the binder and said microvesicles is in a layer comprising a hydrophilic binder in which the microvesicles are dispersed.

* * * * *